United States Patent [19]

Rochlitz et al.

[11] 3,973,959

[45] Aug. 10, 1976

[54] ELECTROPHOTOGRAPHIC RECORDING MATERIAL AND PROCESS FOR ITS MANUFACTURE

[75] Inventors: Jürgen Rochlitz, Breckenheim; Wolfgang Wiedemann, Geisenheim-Johannisberg, both of Germany

[73] Assignee: Hoechst Aktiengesellschaft, Germany

[22] Filed: Apr. 25, 1973

[21] Appl. No.: 354,191

[30] Foreign Application Priority Data

Apr. 26, 1972 Germany ..... 2220408

[52] U.S. Cl. ..... 96/1.5; 96/1.6

[51] Int. Cl.[2] ..... G03G 5/02

[58] Field of Search ..... 96/1.5, 1.6, 1 PF, 1.4, 96/1.8

[56] References Cited

UNITED STATES PATENTS

| | | | |
|---|---|---|---|
| 3,560,360 | 2/1971 | Carreira et al. | 96/1 PE |
| 3,713,820 | 1/1973 | Champ | 96/1.8 |
| 3,725,058 | 4/1973 | Hayashi et al. | 96/1.6 |
| 3,877,935 | 4/1975 | Ragensburger et al. | 96/1.5 |

FOREIGN PATENTS OR APPLICATIONS

| | | | |
|---|---|---|---|
| 16,198 | 7/1968 | Japan | 96/1.5 |

OTHER PUBLICATIONS

Bull Chem. Soc. Japan, vol. 27 No. 1 Feb. 1954, p. 25.

IBM Technical Disclosure Bulletin, vol. 14, No. 9 2/72 p. 2781.

Abstract ASE A-12-L5 Belgium 763540.

*Primary Examiner*—David Klein
*Assistant Examiner*—John L. Goodrow
*Attorney, Agent, or Firm*—James E. Bryan

[57] ABSTRACT

This invention relates to an electrophotographic recording material consisting of an electroconductive support material and a photoconductive double layer of organic materials which consists of a homogeneous, opaque, charge carrier producing dyestuff layer and of a transparent top layer of insulating materials with at least one charge transporting compound as well as to the process for its manufacture.

9 Claims, 2 Drawing Figures

Figure 1:
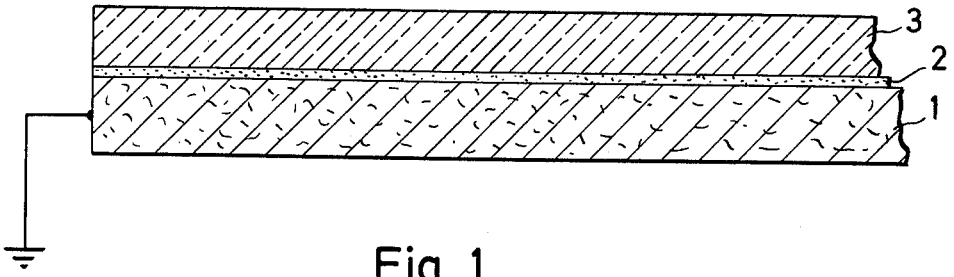

FORMULAE
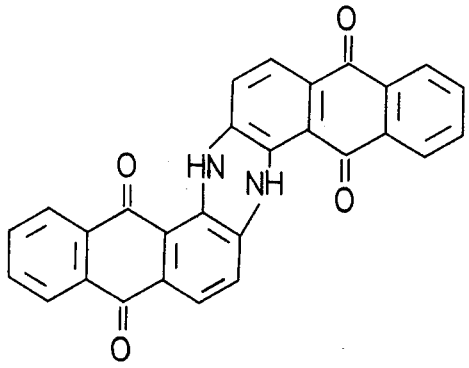
1
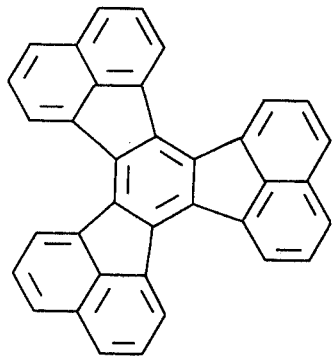
2
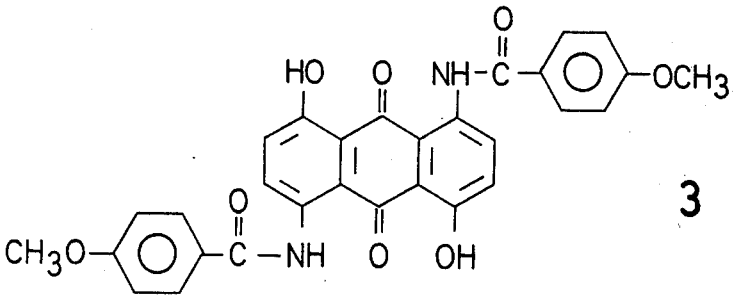
3

FORMULAE
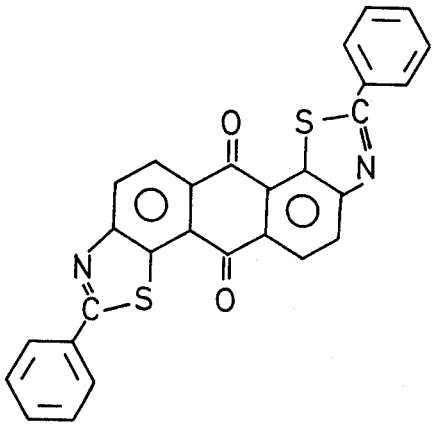
4
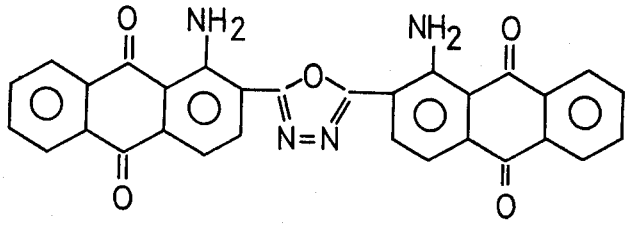
5
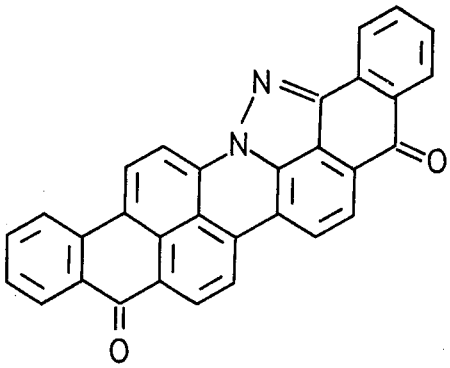
6
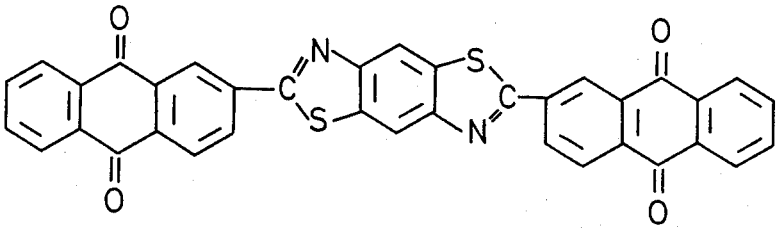
7

FORMULAE
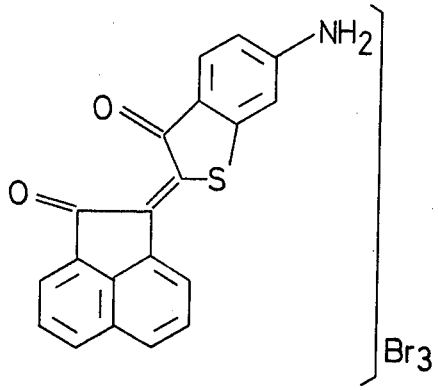
8
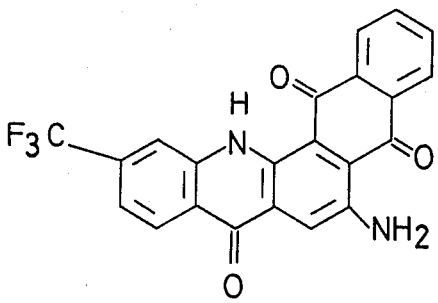
9
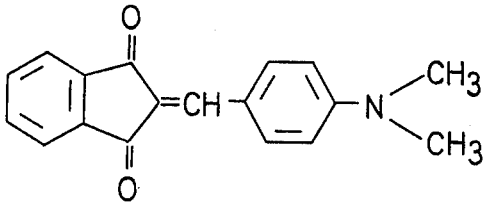
10
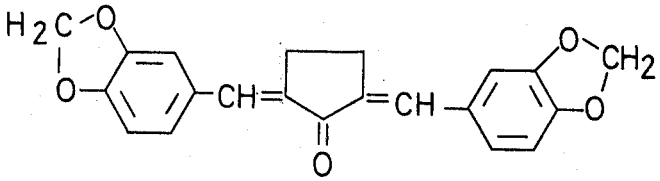
11
$C_{21}H_{16}O_5$

FORMULAE
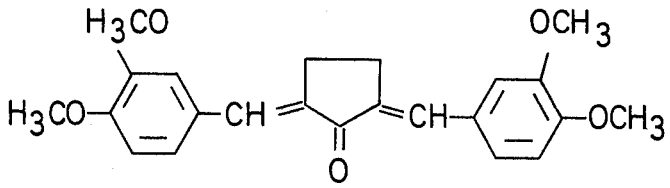
12
$C_{23}H_{24}O_5$
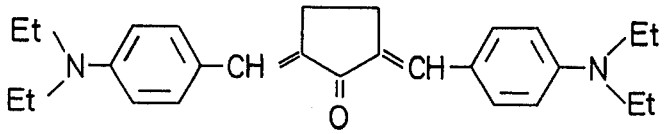
13
$C_{27}H_{34}N_2O$
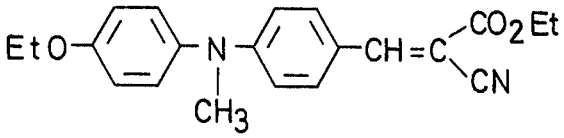
14
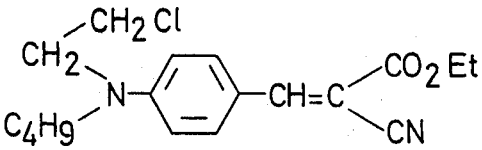
15

ELECTROPHOTOGRAPHIC RECORDING MATERIAL AND PROCESS FOR ITS MANUFACTURE

This invention relates to an electrophotographic recording material consisting of an electroconductive support material and a photoconductive double layer of organic materials which consists of a homogeneous, opaque, charge carrier producing dyestuff layer and of a transparent top layer of insulating materials with at least one charge transporting compound as well as to the process for its manufacture.

It is known from German Offenlegungsschriften Nos. 1,597,877 and 1,797,342 for electrophotographic recording material to extend the spectral sensitivity of selenium layers to the red spectral range by a double layer arrangement, e.g. with phthalocyanine dispersion layers. Disadvantageous are the vacuum vapour depositions of selenium requiring high technical expenditure, the brittleness of comparatively thick selenium layers, the poor adhesion of adjacent heterogeneous constituents in these layers and the only difficultly realizable uniformly wetting coating with the corresponding dispersions. Furthermore, no optimum light-sensitivities can be achieved as a result of the absorption behaviour and the different charge conducting mechanisms of selenium and phthalocyanine in the double layer arrangement.

From U.S. Pat. No. 3,573, 906, for example, there are also known photoconductive double layers containing an organic, possibly photoconductive, insulating layer between the support material and the vapor-deposited selenium layer in order to impart adhesion. Such a layer construction, however, considerably hinders the necessary charge transport so that, in this case too, no higher light-sensitivities are obtainable.

Furthermore, from German Auslegeschrift No. 1,964,817, it is known to provide vapor-deposited selenium layers with a layer of an organic, photoconductive insulating material which is substantially insensitive to light in the visible range of the spectrum. According to German Offenlegungsschrift No. 2,120,912, it has also been suggested to use those light-sensitive layer arrangements for electrophotographic recording materials which contain, as the charge carrier producing layer, an inorganic material, such as the sulfide, selenide, sulfoselenide or telluride of cadmium or zinc, and as the charge carrier transporting layer, an organic material with at least 20 per cent by weight of 2,4,7-trinitro-9-fluorenone. A disadvantage of the production of these layers with inorganic photoconductors is the exact observation of the vapor deposition conditions of selenium or the exact adjustment of the mixtures in order to obtain a good photoconductive modification of the inorganic materials. Furthermore, the adhesion of selenium to conductive support material, such as to aluminium, is insufficient. Fatigue in repeated charge/exposure cycles does not allow the use in electrophotographic copying devices.

Japanese Patent Application No. 43–26710 already discloses photoconductive double layers of organic materials on a conductive support. According to that application, a lower, relatively thick layer of a considerably diluted homogeneous solution of a sensitizer in a binder is provided with an upper transparent light-sensitive layer. This layer construction, however, only offers a relatively low sensitivity increase only little meeting technical demands. Another known suggestion according to German Offenlegungsschrift No. 1,909,742 is to repeatedly pour a sensitizer solution over a photoconductive layer and to evaporate the solvent. A disadvantage thereof is the low mechanical resistance of the applied layer as a result of insufficient cohesion and adhesion of the applied sensitizer. Furthermore, repeated coating is cumbersome.

The construction of photoconductive double layers containing a dyestuff layer is also known, e.g. from Belgian Patents Nos. 763,389 and 763,541, but for this layer construction, top layers are used which allow no sensitivities satisfying highest demands and, as regards adhesion between the dyestuff layer and the top layer, do not represent an optimization and are not sufficiently resistant to mechanical attack, e.g. in electrophotographic copying devices, particularly to that due to the cleaning of the photoconductive layer.

It is the object of the present invention to provide an organic photoconductor layer highly light-sensitive for the xerographic copying procedure which overcomes the described disadvantages and the adhesion of which between the various layers satisfies the highest technical demands, which exhibits no wear of fatigue and which, even after repeated use, may be used again rapidly.

The present invention provides an electrophotographic recording material consisting of an electroconductive support material with a photoconductive double layer of organic materials which consists of a homogeneous, opaque, charge carrier producing dyestuff layer and of a transparent top layer of insulating materials with at least one charge transporting compound and is characterized in that the transparent top layer consists of a charge transporting, monomer, heterocyclic compound substituted by at least one dialkyl amino group or two alkoxy groups and having an extended $\pi$ - electron system and of a binder.

By means of the invention, it is possible to obtain highly light-sensitive, photoconductive double layers for the electrophotographic recording material of the invention which have a high mechanical resistance and may be arranged on a cylindrical drum, for example, or may circulate as an endless belt without exhibiting special signs of wear and thus are very suitable for the use in electrophotograhic copying devices. The high lightsensitivity particularly results from the fact that the charge transporting compound present in the transparent top layer is sensitized by the charge carrier producing dyestuff layer in that the charge carriers, such as electrons or holes are taken by the top layer.

In a preferred embodiment, the organic dyestuff layer has a thickness in the range from about 0.005 to about 2 $\mu$m. High concentration of excited dyestuff molecules is achieved thereby in the dyestuff layer and at the boundary surface between the dyestuff layer and the top layer. Furthermore, the adhesion between the electroconductive support material and the top layer is not impaired.

In a preferred embodiment, the transparent top layer has a thickness in the range from about 5 to about 20 $\mu$m. This assures a sufficiently high charge.

Suitable electroconductive support materials are materials which hitherto have been used for this purpose, for example aluminum foils or transparent plastic supports to which aluminum, gold, copper, zinc, cadmium, indium, antimony, bismuth, tin, lead or nickel has been laminated or applied by vapor deposition. The selection of the metal is determined by the achievable sensitivities, charge heights and their constancy during repeated copying cycles. The kind of the support material also is determined by its purpose of use, e.g. whether the support to be used shall be rigid, self-supporting or flexible.

Suitable homogeneous, opaque, charge carrier producing organic layers are layers of dyestuffs. Those listed in the attached formula table are excellently suitable, for example. They are known under the following designations:

1. Indanthrene Blue — Color Index (C.I.) 69,800
2. Decacyclene (E. Clar, Aromatische Kohlenwasserstoffe, Springer Verlag, Berlin 1952, page 424)
3. Indanthrene Brilliant Violet RK — C.I. 63,365
4. Cibanone Yellow GC — C.I. 67,300
5. Indanthrene Red F3B — C.I. Vat Red 31
6. Indanthrene Navy Blue R — C.I. 70,500
7. Algol Yellow GR — C.I. 66,500
8. Ciba Orange G — C.I. 73,870
9. Trifluoromethyl aminoacridone, free base of Vat Blue 21 — (C.I. 67,920)
10. 2-(p-dimethylaminobenzal)-indanedione-1,3, melting point 102°C, Beilstein 14, 227
11. 2,5-bis-(piperonal)-cyclopentanone-1, melting point 258°C, Beilstein 19, 447
12. 2,5-bis-(3,4-dimethoxybenzal)-cyclopentanone-1, melting point 197°C, Beilstein 8, 530
13. 2,5-bis-(p-diethylaminobenzal)-cyclopentanone-1, melting point 202°C, in analogy with the dimethylamino compound from diethylamino benzaldehyde instead of dimethylamino benzaldehyde, Beilstein 14, 122
14. Celliton Yellow 3 GE — C.I. 48,005
15. Celliton Yellow 7 G — C.I. 48,000
16. Indanthrene Gold Orange GG — C.I. Vat Orange 26

The organic dyestuff layer of the recording material of the invention substantially determines the spectral light-sensitivity of the photoconductive double layer of the invention. The organic dyestuff layer must be extremely uniform since only its uniformity guarantees a uniform injection of charge carriers into the top layer.

To achieve this object, the dyestuff layers are applied according to special coating methods. Such methods are the application by mechanically rubbing the most finely powdered dyestuff material into the electroconductive support material, the application by chemical deposition of a leucobase to be oxidized, for example, the application by electrolytical or electrochemical processes or the gun spray method. The application preferably is performed, however, by vapor depositing the dyestuff in the vacuum. A tightly packed coating is achieved thereby.

The tightly packed coating makes it unnecessary to produce thick dyestuff layers for achieving a high absorption. The tightly packed dyestuff molecules and the extremely low layer thickness permit, in a particularly advantageous manner, the transport of charge carriers so that it is completely sufficient to produce the charge carriers at the boundary layer only.

The application of the dyestuff layer by vapor deposition in the vacuum requires dyestuffs with thermal resistivity in the temperature range to be applied for vapor deposition. The high extinction of the dyestuff allows high concentration of excited dyestuff molecules. Excitation (1) and charge separation (2) take place in the dyestuff layer according to the following reaction equations:

$$1.\ S + h\nu \rightarrow S^*$$

$$2.\ S^* + S \rightarrow S^+ + S^-$$

with S - dyestuff molecule
$S^*$ - excited dyestuff molecule, and
$S^+, S^-$ - dyestuff radical ions At the boundary surface between the organic dyestuff layer and the transparent top layer, reactions of the excited dyestuff molecules or the resulting charge carriers in the form of the dyestuff radical ions with the molecules of the charge transport effecting compound in the top layer are possible according to the following equations:

$$3.\ S^* + F_1 \rightarrow S^- + F_1^+$$

$$4.\ S^* + F_2 \rightarrow S^+ + F_2^-$$

$$5.\ S^+ + F_1 \rightarrow S + F_1^+$$

$$6.\ S^- + F_2 \rightarrow S + F_2^-$$

with $F_1$ - donor molecule
$F_2$ - acceptor molecule
$F_1^+, F_2^-$ - donor or acceptor radical ion At the boundary surface, sensitizing reactions take place between the transparent top layer and the organic dyestuff layer. The top layer thus is a sensitized organic photoconductor at least in the area of the boundary surface, which leads to the surprisingly high photoconductivity.

Reactions 3 and 5 proceed preferably when the $\pi$-electron system in the top layer is a compound which, as a donor compound, easily can release electrons. This is the case with 2,5-bis-(4-diethylaminophenyl)-oxdiazole-1,3,4, for example. But also heterocyclic compounds with only one dialkyl amino group are suitable for rapid procedure of reactions 3 and 5. Reactions 4 and 6 are preferably possible with a substance in the top layer which, as an electron acceptor, easily accepts electrons, e.g. 2,4,7-trinitrofluorenone or 3,6-dinitro-N-t-butyl-naphthalimide.

By means of the specific embodiment of the invention it is sufficient for the efficiency of the dyestuff when, besides its intense absorption, it only has either electron-attracting substituents, e.g. $> C = 0$, $-NO_2$, $-CF_3$, or electron-repelling substituents, e.g. $-NH_2$, $-N\text{-alkyl}_2$ or $-O-$-alkyl, depending on whether it is preferably suitable for reactions 3,5 or 4, 6. The invention permits charge carrier transport fostered by a particularly low expenditure of energy within the tightly packed dyestuff layer according to the following reactions:

$$7.\ S^+ + S \rightarrow S + S^+$$

or $$8.\ S + S^- \rightarrow S^- + S$$

In all conventional sensitizing processes, however, transport via the dyestuff molecules present in low concentration is impeded by their large distance from one another.

Analogous is the charge transport in the top layer with:

$$9.\ F_1^+ + F_1 \rightarrow F_1 + F_1^+ \text{ (p-conductive)}$$

$$10.\ F_2^- + F_2 \rightarrow F_2 + F_2^- \text{ (n-conductive)}$$

The practical consequence of reactions 1 to 10 is that, in the use of electron donors in the top layer, the double layer arrangement is negatively charged so that reactions 3, 5, 8, 9 can proceed. In the inverse case, layers with electron acceptors in the top layer are positively charged so that reactions 4, 6, 7 and 10 can proceed.

The transparent top layer of organic insulating materials with at least one charge transporting compound is described as follows:

The transparent top layer has a high electric resistance and prevents in the dark the flowing off of the electrostatic charge. Upon exposure to light, it transports the charges produced in the organic dyestuff layer.

In the case of negative charge, the transparent top layer preferably consists of a mixture of an electron donor compound and a binder. But when the electrophotographic recording material is to be used for positive charge the transparent top layer consists of a mixture of an electron acceptor compound and a binder.

Consequently, in the transparent top layer there are used compounds for charge transport which are known as electron donors or electron acceptors. They are used together with binders or adhesives adapted to the compound for charge transport as regards charge transport, film property, adhesion, and surface characteristics. Furthermore, conventional sensitizers or substances forming charge transfer complexes are preferably additionally present. But they can only be used in so far as the necessary transparency of the top layer is not impaired. Finally, other usual additives such as levelling agents, plasticizers, and adhesives may also be present.

Suitable compounds for charge transport are especially those organic compounds which have an extended $\pi$ -electron system, e.g. monomer aromatic heterocyclic compounds.

Monomers employed in accordance with the invention are those which have at least one dialkyl amino group or two alkoxy groups. Particularly proved have heterocyclic compounds, such as oxdiazole derivatives, which are mentioned in German Patent No. 1,058,836. An example thereof is in particular the 2,5-bis-(p-diethylaminophenyl)oxdiazole-1,3,4. Further suitable monomer electron donor compounds are, for example, triphenyl amine derivatives, benzo-condensed heterocycles, pyrazoline or imidazole derivatives, as well as triazole and oxazole derivatives, as disclosed in German Patents Nos. 1,060,260 and 1,120,875.

Besides these mentioned compounds having predominantly a p-conductive character, it is also possible to use n-conductive compounds. These so-called electron acceptors are known from German Patent No. 1,127,218, for example. Compounds such as 2,4,7-trinitrofluorenone or N-t-butyl-3,6-dinitro-naphthalimide have proved particularly suitable.

Suitable binders with regard to flexibility, film properties, and adhesion are natural and synthetic resins. Examples thereof are in particular polyester resins, e.g. those marketed under the names Dynapol$^{(R)}$ (Dynamit Nobel), Vitel$^{(R)}$ PE 200 (Goodyear), and which are copolyesters of iso- and terephthalic acid with glycol. Silicone resins are those known under the name SR of General Electric Comp. and representing three-dimensionally cross-linked phenyl-methyl siloxanes have proved particularly suitable. Furthermore, copolymers of styrene and maleic acid anhydrides, e.g. those known under the name Lytron$^{(R)}$, Monsanto, are suitable for use.

The mixing ratio of charge transporting compound to binder may vary. Relatively certain limits are given, however, by the requirement for maximum photosensitivity, i.e. for the biggest possible portion of charge transporting compound, and for crystallization to be prevented, i.e. for the biggest possible portion of binder. A mixing ratio of about 1:1 parts by weight has proved preferable, but mixing ratios from about 3:1 to 1:4 or above, depending on the particular case, are also suitable.

The conventional sensitizers to be used additionally may advantageously foster charge transport. Moreover, they may produce charge carriers in the transparent top layers. Suitable sensitizers are, for example, Rhodamine B extra, Schultz, Farbstofftabellen (dyestuff tables), 1st volume, 7th edition, 1931, No. 864, page 365, Brilliant Green, No. 760, page 314, Crystal Violet, No. 785, page 329, and Cryptocyanine, No. 927, page 397. In the same sense as act the sensitizers may also act added compounds which form charge transfer complexes with the charge transporting compound. Thus, it is possible to achieve another increase of the photosensitivity of the described double layers. The quantity of added sensitizer or of the compound forming the charge transfer complex is so determined that the resulting donor acceptor complex with its charge transfer band still is sufficiently transparent for the organic dyestuff layer below. Optimum concentration is at a molar donor/acceptor ratio of about 10:1 to about 100:1 and vice versa.

The addition of adhesives as binders to the charge transporting compounds already yields a good photosensitivity. In this case, low-molecular polyester resin, such as Adhesive 49,000, Du Pont, has proved particularly suitable.

In the described manner, the top layers have the property to render possible a high charge with a small dark discharge. Whereas in all conventional sensitizations an increase of the photosensitivity is connected with an increase of the dark current, the arrangement of the invention can prevent this parallelity. The layers are thus usable in electrophotographic copying devices with low copying speeds and very small lamp energies as well as in those with high copying speeds and correspondingly high lamp energies.

Figure 2:
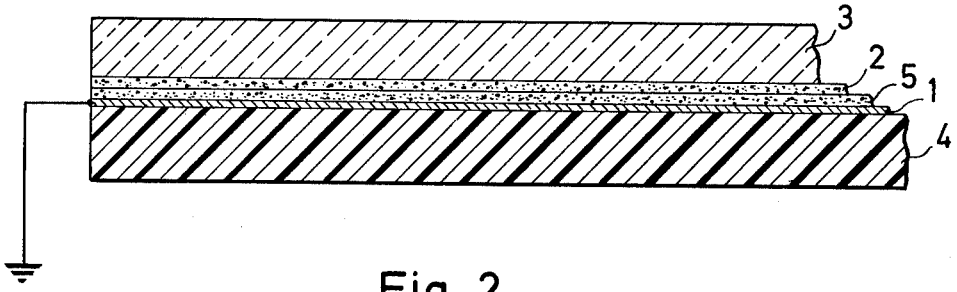

The attached FIGS. 1 and 2 are diagrammatic views of the electrophotographic recording material.

FIG. 1 shows the photoconductive double layer of charge carrier producing organic dyestuff layer 2 and transparent top layer 3 of insulating organic materials and at least one charge transporting compound on a metallic support 1, and FIG. 2 shows the same on a metallized plastic film 1,4.

It has been found that, by the use of the above dyestuffs in the dyestuff layer 2 with the charge transporting compound with the extended $\pi$-electron system and present in the transparent top layer 3, such as 2,5-bis-(p-diethylamino-phenyl)-oxdiazole-1,3,4 and the electroconductive support 1, considerable sensitivity increases can be obtained compared to the compound alone contained in the top layer 3.

The electrophotographic recording material according to the invention is produced by applying a lower dyestuff layer to the electroconductive support material and by applying thereabove a transparent top layer of organic insulating materials with at least one charge transporting compound. As stated before, the dyestuff layer may be applied according to special coating methods, such as mechanical rubbing of the most finely powdered dyestuff into the electroconductive support material or by chemical deposition of a leucobase to be oxidized, by electrolytical or electrochemical processes or by gun spray methods. It has been found, however, that vapor deposition of the dyestuff in the vacuum is particularly suitable.

Another object of the present invention therefore also is a process for the manufacture of the electrophotographic recording material by applying a photoconductive double layer to an electroconductive support material, which is characterized in that a charge carrier producing organic dyestuff is homogeneously applied at a temperature from about 100° to 500° C by vapor deposition in the vacuum to the electroconductive support material to yield a high absorption, which dyestuff is subsequently coated with a transparent top layer of insulating organic materials with at least one charge transporting compound by applying a solution of the material, evaporating the solvent, and drying in a conventional manner. Relatively tight packing of the dyestuff molecules is achieved thereby, which, in the case of a small layer thickness, allows the production of charge carriers of high concentration, particularly at the boundary layer.

In a preferred embodiment, the organic dyestuff is applied by vapor deposition to the electroconductive support material at a temperature from 150° to 350° C under reduced pressure of about $10^{-3}$ to about $10^{-6}$ mm Hg, preferably $10^{-3}$ to $10^{-4}$ mm Hg. Vapor deposition must be performed homogeneously and in a period as short as possible so that gentle treatment of the dyestuff is guaranteed even at an elevated temperature.

The duration of vapor deposition depends on various factors, such as the prevailing temperature, the applied pressure and the vapor pressure of the dyestuff. A duration of about 10 minutes is possible. But it has proved that a duration of vapor deposition as short as possible is advantageous, which is in the range from about 2 to 4 minutes.

For the selection of the dyestuff to be vapor-deposited, it is furthermore important that it can be sublimed or evaporated in the undecomposed state. The dyestuff may be evaporated by direct heating, preferably by indirect heating, of its surface or its melt. The distance between the source of evaporation and the electroconductive support material is so selected that the temperature of the support material is as low as possible, preferably between room temperature of 20° C and 100° C. In this connection, it may be of advantage to cool the support material.

Coating of the dyestuff layer is performed according to a conventional method, e.g. by casting or doctoring the solutions, solvents being used which either evaporate rapidly or the method is so selected that rapid evaporation is assured. Overcoating also may be performed according to another conventional method, e.g. by laminating.

Coating with a slot nozzle has proved particularly suitable. A short period of contact between the solution and the dyestuff layer is guaranteed thereby, when, for example, the support to be coated, e.g. a tape, is passed into a drying channel shortly after the application of the solution, the temperature of which channel is between 60° and 140° C, depending on the length and boiling temperature of the solvent.

Advantageous solvents for the described top layer materials are in particular tetrahydrofurane, dioxane, and glycol monomethyl ether (methyl glycol). But is is also possible to use other known solvents which rapidly and easily dissolve the top layer materials proved useful.

The invention is further illustrated by way of the attached examples.

EXAMPLE 1

For the preparation of a photoconductive double layer, Indanthrene Blue, Color Index No. 69,800, e.g. Paliogen Blue 6470 of BASF, Ludwigshafen, Germany, (Formula 1) is vapor deposited by a vacuum pump (Type A 1 of Pfeiffer, Wetzlar, Germany,) at a reduced pressure of $10^{-3}$ to $10^{-4}$ mm Hg onto a 100 $\mu$m thick aluminium foil arranged at a distance of about 15 cm. Within 1 to 3 minutes, at a vapor deposition temperature of about 360° to 390°C, a very homogeneous, opaque, blue colored dyestuff layer is obtained.

For testing the electrophotographic properties, an about 10 $\mu$m thick top layer is applied to the dyestuff layer. For this purpose, one part by weight of 2,5-bis-(4-diethylaminophenyl)-oxadiazole-1,3,4, one part by weight of polyester resin, e.g. Dynapol L 206 of Dynamit Nobel AG, Troisdorf, Germany, and $10^{-3}$ part by weight of cryptocyanine as the sensitizer are whirl-coated as a 20 per cent solution in tetrahydrofurane. Subsequently, the homogeneous, glossy layer is dried for 5 minutes at 120° C.

For comparing the photosensitivities, a similar top layer is analogously prepared on an aluminium foil (zero layer = O-layer).

For measuring the photosensitivity, the photoconductor double layer is negatively charged by passing it three times through a charging device (Type AG 56 of Kalle AG, Wiesbaden-Biebrich, Germany) adjusted to 7.5 kV. The layer is then exposed to an Osram xenon lamp, type XBO 150. The intensity of illumination in the plane of measurement is about 300 lx. The charge height and the curve of the photo-induced light decay of the photoconductor layer are measured through a probe by an electrometer (type 610 B of Keithley Instruments, U.S.A.) according to the method described by Arneth and Lorenz in Reprographie 3, 199 (1963). The photoconductor layer is characterized by the charge height ($U_o$) and the time ($T_{1/2}$) after which half of the charge $U_o$ /2 is achieved:

| Layer | $U_o$ (V) (negative charge) | $T_{1/2}$ (msec) |
|---|---|---|
| O-layer | 1,150 | 9,000 |
| Double layer | 600 | 270 |

EXAMPLE 2

A yellow colored layer on a 100 $\mu$m thick aluminium foil is prepared by vapor depositing decacyclene (Formula 2) in about 15 minutes at about 310° to 330°C at a reduced pressure of $10^{-3}$ to $10^{-4}$ mm Hg.

This layer is whirl-coated with a solution from one part by weight of 2,5-bis-(4-diethylaminophenyl)-oxadiazole-1,3,4, and one part by weight of polyester resin, e.g. Dynapol L 206 of Dynamit Nobel AG, Troisdorf, Germany, in a 20 per cent solution of tetrahydrofurane (THF). After drying, the layer thickness is about 8 to 10 μm. The photosensitivity of this double layer is compared with that of a O-layer of the same top layer thickness, the measuring conditions being those of Example 1.

| Layer | $U_o$ (V) (negative charge) | $T_{1/2}$ (msec) |
|---|---|---|
| O-layer | 1,200 | 525 |
| Double layer | 1,175 | 245 |

EXAMPLE 3

To dyestuff layers of Indanthrene Blue, C.I. 69,800, e.g. Cromophthal Blue A 3 R of Ciba AG, Basel, Switzerland, quality E (Formula 1) which are vapor deposited in analogy with Example 1, transparent top layers of the following composition are applied:

a. 1 part by weight of 2,5-bis-(p-diethylaminophenyloxdiazole-1,3,4, and 1 part by weight of polyester resin (20 per cent in THF)

b. the same component as in (a), plus 0.1 part by weight of 3,5-dinitrobenzoic acid The thickness of the top layers is about 10 μm.

The photosensitivity of these samples at a negative charge is determined with a higher light intensity and according to a modified method: on a slowly rotating disk, the photoconductor layer moves through a charging device (corona adjusted to 6 to 7 kV, grid 1 to 1.5 kV to the exposure section where it is exposed to an Osram xenon lamp, type XBO 150. A heat absorbing glass type(KG 3 of Schott + Gen., Mainz, Germany,) and a neutral filter of about 10 per cent transparency are placed before the lamp so that the light intensity in the plane of measurement is about 750 μW/cm².

The charge height and the curve of the photo-induced light decay are oscillographically recorded by an electrometer, type 610 CR of Keithley Instruments, U.S.A., through a transparent probe.

The determination of the charge height ($U_o$) and of the half time ($T_{1/2}$) yields the following values for the double layers as well as the O-layers prepared for comparison purposes

| Layer | $U_o$ (V) (negative charge) | $T_{1/2}$ (msec) |
|---|---|---|
| a | 1,200 | 110 |
| O-layer | 900 | 240 |
| b | 800 | 210 |
| O-layer | 1,150 | 720 |

EXAMPLE 4

After vapor deposition in double layer arrangement, a number of further dyestuffs has a substantially improved photosensitivity compared with that of a top layer without a dyestuff layer. The dyestuff layers were vapor-deposited in the apparatus described in Example 1 under the following conditions:

| Dyestuff | Formula | Time (min) | Temperature (°C) |
|---|---|---|---|
| Indanthrene Brilliant Violet RK,C.I. 63,365 | 3 | 2 | 320 |
| Cibanone Yellow GC, C.I. 67,300 | 4 | 3 | 350 to 380 |
| Indanthrene Red F3B, C.I. Vat Red 31 | 5 | 10 | 450 |
| Indanthrene Blue, C.I. 69,800 | 1 | 2 | 370 |

The layer weights of the vapor-deposited dyestuffs are in the range from about 0.01 to 0.5 g/m², which approximately corresponds to a thickness of 0.01 to 0.5 μm, at an assumed density of $d = 1$.

To these layers, there is applied a top layer from one part by weight of 2,5,-bis-(4-diethylaminophenyl)-oxdiazole-1,3,4, one part by weight of polyester resin, e.g. Dynapol L 206 of Dynamit Nobel AG, Troisdorf, Germany, and $10^{-3}$ part by weight of Brilliant Green as the sensitizer. The top layer thickness is about 9 μm. A O-layer is prepared analogously.

The photosensitivity is determined as in Example 1 (negative charge, 300 1x in the plane of measurement):

| Layer | Dyestuff according to Formula | $U_o$(V) (negative charge) | $T_{1/2}$(msec) |
|---|---|---|---|
| O-layer | | 1,400 | 280 |
| Double layer | 3 | 920 | 195 |
| Double layer | 4 | 1,100 | 89 |
| Double layer | 5 | 1,225 | 156 |
| Double Layer | 1 | 950 | 190 |

EXAMPLE 5

The following further dyestuffs also are excellently suitable for the electrophotographic double layers. In analogy with Example 1, these materials may be vapor-deposited under relatively gentle conditions:

| Dyestuff | Formula or No. | Time (min) | Temperature (°C) |
|---|---|---|---|
| a) Algol Yellow GR (C.I.66,500) | 7 | 2 | 370 |
| b) Indanthrene Gold Orange GG (C.I. Vat Orange 26) | 16 | 3 | 350 |
| c) Indanthrene Navy Blue R (C.I.70,500) | 6 | 6 | 410 |

To these homogeneous, glossy dyestuff layers, there is applied a top layer from one part by weight of 2,5-bis-(4-diethylaminophenyl)-oxadiazole-1,3,4 and one part by weight of polyester resin, e.g. Dynapol L 206, in a thickness of about 10 μm.

The measurement of the photosensitivity with negative charge according to Example 3 yields the following values:

| Layer | $U_o$ (V) | $T_{1/2}$(msec) |
|---|---|---|
| O-layer | 900 | 240 |
| a | 1,200 | 42 |
| b | 1,160 | 125 |
| c | 900 | 115 |

EXAMPLE 6

In analogy with Example 1, layers of the dyestuff Ciba Orange G, C.I. 73,870,(Formula 8), were vapor-deposited on aluminium sheets within 4 minutes at a temperature of 350° C under a reduced pressure of $10^{-3}$ to $10^{-4}$ mm Hg. For determining the thickness of the dyestuff layer, the following comparison test is carried out: When the dyestuff of Formula 8 is vapor-deposited on a transparent 50 μm thick polyester film, a layer is obtained for the given conditions which has an extinction of 1.3 at 410 nm. With an assumed extinction coefficient of $\epsilon = 1.0 \cdot 10^5$ (410 nm), a layer of 0.08 g/m² or a dyestuff layer thickness of 0.08 μm is calculated per 2 cm², the assumed density of the dyestuff being $d = 1$.

Top coating also was performed in analogy with Example 1. The top layer materials used were 1:1 mixtures of 2,4,7-trinitrofluorenone (TNF) and a polyester resin, e.g. Dynapol L 206, or of 2,5-bis-(4-ethylaminophenyl)-oxadiazole-1,3,4(To) and a copolymer from styrene and maleic acid anhydride, e.g. Lytron 820 of Monsanto Corp., U.S.A. Sensitizers, such as Rhodamine B (RhB) in a quantity of 0.3 per cent, calculated on the solid layer constituents, and Brilliant Green (BG) in a quantity of 0.05 per cent also were added to the top layers. For comparison purposes, corresponding top layers were prepared without dyestuff layers (O-layers). The measured values of the sensitivities, measured according to Example 1, are as follows:

| Top layer | $U_o$(V) | $T_{1/2}$ (msec) |
|---|---|---|
| TNF | + 480 | 45 |
| TNF + RhB | + 410 | 44 |
| To | − 1,040 | 68 |
| To + RhB | − 750 | 32 |
| To + BG | − 1,020 | 36 |
| O-layer TNF | + 500 | > 1,000 |
| O-layer To | − 420 | > 1,000 |

EXAMPLE 7

In analogy with Example 1, the blue dyestuff of Formula 9 was vapor-deposited for 6 minutes at 310°C under a reduced pressure of $10^{-3}$ to $10^{-4}$ mm Hg. The preparation of the double layer was performed in analogy with Example 6 and the measurement in analogy with Example 1.

When the dyestuff 6 is vapor-deposited in analogy with Example 6 above on a transparent polyester film without a conductive aluminum layer, a layer thickness is obtained under the given conditions which has an extinction of about 2.0 at 650 nm. When assuming that the extinction coefficient is $\epsilon = 0.5 \cdot 10^5$ a coating of 0.15 g/m² or 0.15 μm thickness with an assumed density of $d = 1$ is obtained.

The values of the found sensitivities are:

| Top layer | $U_o$(V) | $T_{1/12}$ (msec) |
|---|---|---|
| a) TNF + RhB | + 670 | 112 |
| b) To | − 730 | 92 |
| c) To + BG | − 1,200 | 164 |
| d) O-layer TNF | + 500 | > 1,000 |
| e) O-layer To | − 420 | > 1,000 |

By a Dyn-Test 90 apparatus of ECE, Giessen, Germany, for measuring the sensitivity, the factor of the sensitivity $$f = \frac{U_o}{U_h + \Delta U_d}$$

was determined with the yellow filter.

$U_o$ : initial voltage
$U_o$ : voltage after exposure for 2 seconds, and
$\Delta U_d$: dark decay after 2 seconds The factor $f$ found for layer $a$ was 1.7 and that for layer $c$ 1.6. The factor $f$ for O-layers is 1.0.

EXAMPLE 8

The yellow and orange colored dyestuffs of Formulae 10 to 13 were vapor-deposited (in analogy with Example 1); coating with the top layer and measuring also were performed according to Examples 6 and 1, respectively. The results are summarized in the table. Vapor deposition was carried out at 180°C and $10^{-3}$ to $10^{-4}$ mm Hg. For the preparation of the top layer on dyestuff No. 13, 3,6-dinitro-N-t-butyl-naphthalimide (DNI) was employed as the electron acceptor substance in the top layer. The charge transporting substances were applied in a 1:1 mixture with a polyester resin, e.g. Dynapol L 206, in a 15 per cent solids concentration in tetrahydrofurane. DNI was prepared in analogy with N-methyl-naphtalimide (Beilstein 21, 527) from 3,6 dinitronaphthalic acid anhydride and t-butylamine (according to Beilstein 17, II 496).

| Dyestuff | Duration of vapor deposition min | Top layer | $U_o$(V) | $T_{1/2}$ (msec) |
|---|---|---|---|---|
| 10 | 0.5 | To | − 700 | 520 |
| 11 | 2.5 | To | − 1,240 | 610 |
| 12 | 2.5 | To | − 1,170 | 520 |
| 13 | 2.5 | TNF | + 1,350 | 230 |
| 13 | 2.5 | To | − 1,000 | 580 |
| 13 | 2.5 | DNI+RhB | + 1,540 | 350 |
| — | — | O-layer TNF | + 500 | > 1,000 |
| — | — | O-layer To | − 420 | > 1,000 |

Further condensation products from aromatic aldehydes with activated methylene compounds are dealt with in the following examples.

EXAMPLE 9

In analogy with Example 1 the yellow dyestuffs of Formulae 14 and 15 were vapor-deposited, provided with a top layer and measured. The following results were achieved:

| Dyestuff | Vapor deposition conditions (°C, min, mm Hg) | Top layer | $U_o$(V) | $T_{1/2}$ (msec) |
|---|---|---|---|---|
| 14 | 250°, 1,5.10⁻4 | To | − 600 | 250 |
| 15 | 200°, 1,5.30.10⁻4 | To | − 590 | 148 |
| — | — | O-layer | − 420 | 1,000 |

EXAMPLE 10

As further dyestuff layers for testing polymer, charge-transporting compounds, there are selected for comparison purposes layers according to Example 5(a), a. a solution of poly-N-vinylcarbazole, e.g. Luvican M 170 of BASF, Ludwigshafen, Germany, with 18.6 per cent by weight of polyester resin, e.g. Adhesive 49,000 of Du Pont, U.S.A., in tetrahydrofurane being whirl-coated onto the yellow opaque dyestuff layer. The top layer thickness is about 6 $\mu$m. A O-layer is prepared for comparison purposes.

The results are as follows:

Photosensitivity, measured according to Example 3:

Charge: − 800 V; $T_{1/2}$ : 48 msec.

The result for the O-layer is:

Charge: −550 V; $T_{1/2}$ >>1 sec.

b. To solution (a) there is added 2,4,7-trinitrofluorenone for the formation of a charge transfer complex in such a quantity that the activation polyvinyl carbazole/2,4,7-trinitrofluorenone is 20:1. The solution is whirl-coated onto an above-mentioned dyestuff layer. The top layer thickness is about 6 $\mu$m. A O-layer is prepared for comparison purposes. The photosensitivity of this double layer, measured again according to Example 3, is as follows:

Charge: −1,000 V; $T_{1/2}$ = 32 msec.

The values for the O-layer are as follows:

Charge: −1,050 V and $T_{1/2}$ = 103 msec.

EXAMPLE 11

The most finely powdered dyestuff according to Formula 8 is thoroughly rubbed with a leather on an aluminum plate until good adhesion to the metal is achieved. Subsequently, coating is performed, as described in Example 2, with a solution from one part by weight of 2,5-bis-(p-diethyl-aminophenyl)-oxadiazole-1,3,4 and one part by weight of polyester resin, e.g. Dynapol L 206, in tetrahydrofurane (20 per cent). After drying for 5 minutes at 120° C measurement is carried out under the conditions of Examples 3. With a charge of −580 V, the half time value of the voltage decay is 120 msec.

It will be obvious to those skilled in the art that many modifications may be made within the scope of the present invention without departing from the spirit thereof, and the invention includes all such modifications.

What is claimed is:

1. An electrophotographic recording material consisting of an electroconductive support material and a photoconductive double layer of organic materials which consists of a homogeneous, opaque charge carrier producing dyestuff layer, prepared by vacuum evaporation of the dyestuff onto the support material, the dyestuff being selected from the group consisting of Indanthrene Blue, decacyclene, Indanthrene Brilliant Violet RK, Cibanone Yellow GC, Indanthrene Red F3B, Indanthrene Navy Blue R, Ciba Orange G, trifluoromethylaminoacridone, 2-(p-dimethylaminobenzal)-indanedione-1,3, 2-5-bis-(piperonal)-cyclopentanone-1, 2,5-bis-(3,4-dimethoxybenzal)-cyclopentanone-1, 2,5-bis-(p-diethylaminobenzal)-cyclopentanone-1, Celliton Yellow 3GE, Celliton Yellow 7G and Indanthrene Gold Orange GG, and a transparent top layer of insulating material with at least one charge transporting compound, said top layer consisting of a mixture of a charge transporting, monomeric, heterocyclic compound selected from the group consisting of oxazoles, oxdiazoles, triazoles, imidazoles and pyrazoles, substituted by at least one dialkylamino group or two alkoxy groups and having an extended $\pi$-electron system, and a binder in the ratio by weight of about 1 : 1, the dyestuff layer having a thickness of about 0.005 to 2 microns and the transport top layer having a thickness of about 5 to 20 microns.

2. A material according to claim 1, in which the heterocyclic compound is an oxadiazole.

3. A material according to claim 1, in which the heterocyclic compound is 2,5-bis-(4-diethylaminophenyl)-oxadiazole-1,3,4.

4. A material according to claim 1, in which the transparent top layer is composed of a mixture of the charge transporting compound and the binder in a ratio by weight of about 1:1.

5. A material according to claim 1, in which the binder is selected from the group consisting of polyesters, copolyesters, silicone resins, and of the copolymers of styrene and maleic acid anhydride.

6. A material according to claim 1, in which the binder is a copolymer from isophthalic acid and terephthalic acid with glycol.

7. A material according to claim 1, in which the binder is a copolymer from styrene and maleic acid anhydride.

8. A material according to claim 1, in which the binder is a low-molecular weight polyester resin.

9. A material according to claim 1, in which the transparent top layer additionally contains sensitizers and/or substances forming charge transfer complexes.

* * * * *